United States Patent [19]

Hagenfeldt et al.

[11] Patent Number: 4,765,953

[45] Date of Patent: Aug. 23, 1988

[54] HIGH NITROGEN CONTAINING DUPLEX STAINLESS STEEL HAVING HIGH CORROSION RESISTANCE AND GOOD STRUCTURE STABILITY

[75] Inventors: Carl P. U. Hagenfeldt, Sandviken; Sven-Olof Bernhardsson, Falun; Erik V. S. Lagerberg, Sandviken, all of Sweden

[73] Assignee: Santrade Limited, Lucerne, Switzerland

[21] Appl. No.: 903,710

[22] Filed: Sep. 5, 1986

[30] Foreign Application Priority Data

Sep. 5, 1985 [SE] Sweden ..... 8504131

[51] Int. Cl.[4] ..... C22C 38/44

[52] U.S. Cl. ..... 420/65; 420/52; 420/59; 148/325; 148/327

[58] Field of Search ..... 420/57, 58, 59, 52, 420/65, 67; 148/325, 327

[56] References Cited

U.S. PATENT DOCUMENTS 4,500,351 2/1985 Bond et al. ..... 420/52

FOREIGN PATENT DOCUMENTS 2348292 12/1974 Fed. Rep. of Germany ..... 420/57
50-91516 7/1975 Japan ..... 420/49
451786 11/1974 U.S.S.R. ..... 420/65

*Primary Examiner*—Deborah Yee
*Attorney, Agent, or Firm*—Burns, Doane, Swecker & Mathis

[57] ABSTRACT

According to the invention there is a high nitrogen containing duplex stainless steel with high corrosion resistance and good structure stability. Characteristic is the analysis of the alloy being in % by weight max 0.05% C, 23–27% Cr, 5.5–9.0% Ni, 0.25–0.40% N, max 0.8% Si, max 1.2% Mn, 3.5–4.9% Mo, max 0.5% Cu, max 0.5% W, max 0.010% S, max 0.5% V, max 0.18% Ce and Fe and normally present impurities, at which the contents of the alloying elements are so adjusted that the ferrite content after solution heat treatment at about 1075° C. amounts to 30–55%. The analysis of the steel is so optimized that it in solution heat treated, cold worked and also welded condition is particularly suitable for use in such environments where the presence of chloride ions gives rise to a high corrosivity.

8 Claims, 2 Drawing Sheets

HIGH NITROGEN CONTAINING DUPLEX STAINLESS STEEL HAVING HIGH CORROSION RESISTANCE AND GOOD STRUCTURE STABILITY

The present invention relates to a ferrite-austenitic Cr—Ni—Mo—N steel with high corrosion resistance and good structure stability. Duplex (ferrite-austenitic) stainless steels have several interesting properties, such as high strength and good resistance to stress corrosion. An increase of the alloying content will also give good resistance to pitting and crevice corrosion. High contents of the active alloying elements chromium, molybdenum and tungsten, however, increase the tendency for precipitation of intermetallic phases so strongly that problems can be obtained in the manufacturing and in connection with welding. Nitrogen stabilizes the alloy against precipitation of intermetallic phases at the same time as an increase of the resistance to pitting and crevice corrosion will be obtained. Thus a high content of N is desirable but is confined because of a limited solubility of nitrogen in the melt, which gives rise to porosity, and because of the solubility of nitrogen in the solid phase, which causes precipitation of chromium nitrides.

If the composition in the two phases is not the same with respect to active components, one phase will be more sensitive to pitting and crevice corrosion, which reduces the resistance of the alloy.

The optimizing of a duplex stainless steel with high corrosion resistance and good structure stability is thus very complex. Systematic development work has, however, resulted in a duplex stainless steel which in a surprising way combines a number of good properties, and this will be shown in the following. The composition of the alloy is not the most important factor, but more important is the balance between various alloying components and structure factors.

The alloying composition and the microstructure of the alloy according to the invention are as follows:

C—max 0.05%
Si—max 0.8%
Mn—max 1.2%
Cr—23-27%
Ni—5.5-9.0%
Mo—3.5-4.9%
Cu—max 0.5%
W—max 0.5%
V—max 0.5%
N—0.25-0.40%
S—max 0.010%
Ce—max 0.18% and the remainder Fe besides normally present impurities, at which the alloying contents are so adjusted that the content of ferrite, $\alpha$, is 30-55%.

Chromium is one of the most active elements in the alloy. Chromium increases the resistance to pitting and crevice corrosion and increases the solubility of nitrogen in melt as well as in solid solution. A high chromium content, >23%, is therefore desirable, preferably higher than 24.5%.

Chromium increases, however, in combination with molybdenum, tungsten, silicon and manganese, the tendency for precipitation of intermetallic phases. The sum of chromium, molybdenum, tungsten, silicon and manganese in the alloy has therefore to be limited. Nitrogen reduces the content of chromium in the ferrite phase and will therefore reduce the tendency for precipitation of intermetallic phases. The amount of ferrite in the alloy is also important through the influence on the phase composition. A decreased content of ferrite favors intermetallic phases. The chromium content should not exceed 27%.

Molybdenum is also a very active alloying element. Molybdenum increases the resistance to pitting and crevice corrosion. It has also been found that molybdenum in combination with a high content of austenite and high solubility in the austenite phase decreases the tendency for nitride precipitation in solid phase. A high content of molybdenum, >3.5%, is therefore necessary in the alloy, suitably higher than 3.8% and preferably higher than 4.05%.

But similar to chromium, molybdenum increases the tendency for precipitation of intermetallic phases and the content of molybdenum has therefore to be limited to max 4.9%.

Tungsten is an alloying element related to molybdenum and has a similar influence on the resistance to pitting and crevice corrosion as well as on the structure stability. Tungsten has, however, twice as high an atomic weight as molybdenum, it costs twice as much per weight unit as molybdenum, and increases the handling difficulties in the steel manufacturing. Tests and calculations of alloying with tungsten have shown that the manufacturing costs are considerably increased. The content of tungsten is therefore limited to 0.5 percent by weight.

Nitrogen is the most important alloying element in this new alloy. Nitrogen has a great number of effects on properties, microstructure and manufacturing cost. Nitrogen influences the distribution coefficient of chromium and molybdenum so that a higher content of nitrogen increases the content of chromium and molybdenum in the austenite. This has the following effects:

The contents of chromium and molybdenum in the ferrite decrease which reduces the tendency for precipitation of intermetallic phases which are precipitated in the ferrite or in the phase boundary ferrite-austenite.

The most frequently present intermetallic phases in this kind of alloy are $\sigma$-and $\chi$-phase. None of these phases has any considerable solubility of nitrogen. A higher content of nitrogen will therefore delay the precipitation of $\sigma$- and $\chi$-phase.

In welding operations nitrogen facilitates the reprecipitation of austenite which drastically improves the toughness and corrosion resistance of the welding joint. The rapid re-precipitation of austenite caused by nitrogen also decreases the tendency to precipitation of intermetallic phases. At the rapid precipitation the ferrite-stabilizing elements, among others chromium and molybdenum, are frozen in the austenite phase. The diffusion rate of the alloying elements in the austenite phase is considerably lower than in the ferrite phase. In other words there is obtained in the welding material and the heat-influenced zone a state of non-equilibrium, which lowers the contents of chromium and molybdenum in the ferrite phase, obstructing the precipitation of intermetallic phases.

Systematic examinations showed that the measure of the corrosion resistance (PCCR)* is given by (in percent of weight):

$$PCCR = \%\ Cr + 3.3\%\ Mo + 16\%\ N - 1.6\%\ Mn - 122\%\ S \quad (1)$$

* (i.e. Pitting and Crevice Corrosion Resistance)

As the compositions of the austenite- and the ferrite phases are different, the PCCR of the phases are also different, i.e. the corrosion resistance of the differing phases is different. In duplex stainless steels available up to now it is generally regarded that PCCR is lower for the austenite phase than for the ferrite phase.

Our investigations have shown, however, that it is possible, by careful balancing of the nitrogen content and the austenite-ferrite ratio, to obtain an alloy in which PCCR is the same for the two phases at a solution heat treatment temperature being practically applicable.

BRIEF DESCRIPTION OF THE DRAWINGS

The effect of nitrogen is shown in FIG. 1, for alloys in which the content of ferrite has been held constant=70% at 1200° C. through varying additions of nickel. FIG. 1 shows that an increased content of nitrogen lowers the temperature, at which PCCR is the same for the two phases, $\alpha$ and $\gamma$, respectively. The investigation was performed at different solution heat treatment temperatures (see the axis of abscissa). Furthermore PCCR increases strongly, more than what can be attributed to an increased nitrogen content, because nitrogen above all increases PCCR of the weaker phase, the austenite, regarding the corrosion resistance.

The alloy according to the invention has therefore an extremely high PCCR and corrosion resistance depending upon said optimizing of the nitrogen content and the ferrite content which also means that the annealing temperature can be chosen optionally from a manufacturing point of view. Systematic examinations have shown that the numeric value of PCCR should exceed 39.1.

It has been found that the following conditions have to be fulfilled in order to reach PCCR-equilibrium:

$$65 < 71.1 + 9(7.5 - \%\,Ni) + 190(0.03 - \%\,C) + 160(0.25 - \%\,N) + 5.3(\%\,Cr - 25) + 8(\%\,Mo - 4) < 75 \quad (1a)$$

$$\%\,N \geqq \frac{1075 - 16(\%\,Cr - 25) + 52(\%\,Mo - 4)}{4064} \quad (1b)$$

Figure 1:
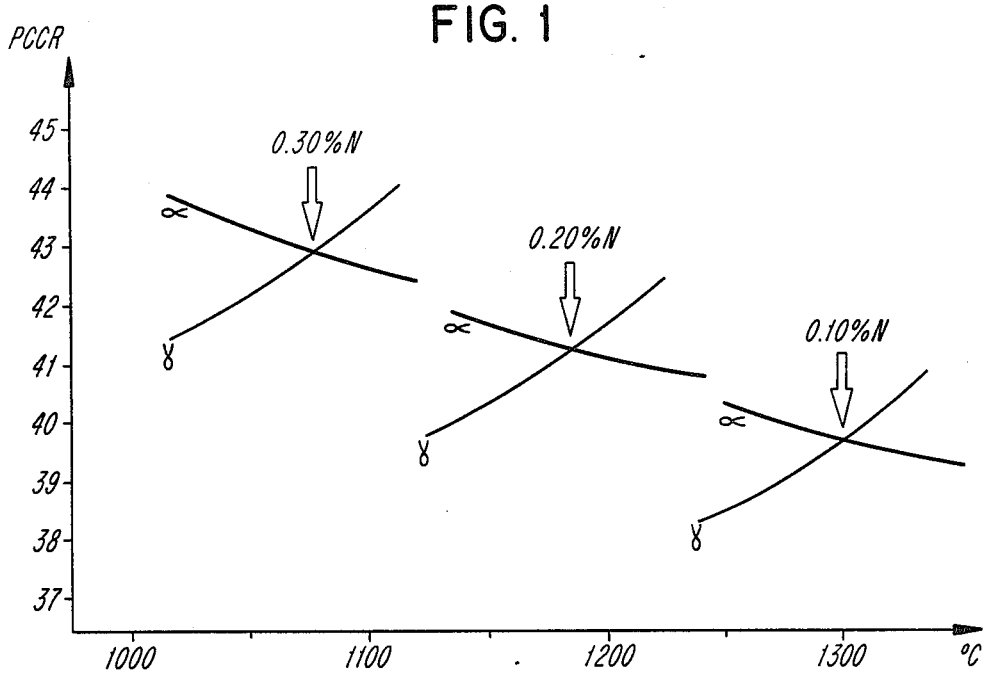
FIG. 1 is a graph of Pitting and Crevice Corrosion Resistance (PCCR) versus temperature for varying degrees of nitrogen in an alloy with a constant ferrite content.
Figure 2:
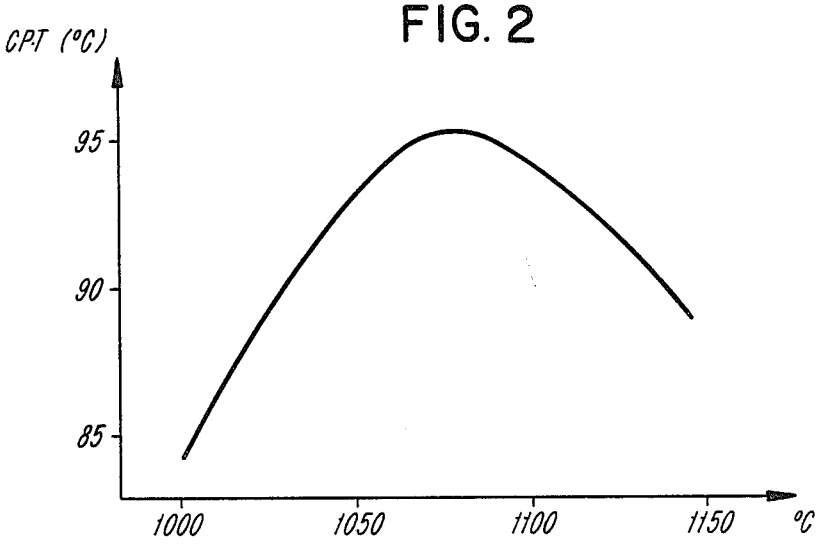
FIG. 2 is a graph of the critical temperature of pitting (CPT) versus solution heat treatment temperature in an alloy according to the present invention.

FIG. 2 shows how the critical temperature of pitting (CPT) varies with the solution heat treatment temperature in an alloy according to the invention with 25% Cr, 6.8% Ni, 4% Mo and 0.30% N. The temperature giving the maximum pitting resistance is about 1075° C. The corrosion tests were performed in 3% NaCl with an applied potential of 600 mV vs. SCE.

A nitrogen content of at least 0.25% is demanded to obtain a good corrosion resistance, but a nitrogen content above 0.28% is desirable. Nitrogen has, however, a limited solubility both in the melt and in the solid phase.

Systematic investigations have shown that the following is valid in the melt in order to avoid porosities in connection with casting, $$\%\,Cr \geqq 23\% \quad (2)$$

$$\frac{\%\,Cr + 0.51\%\,Mn + 0.22\%\,Mo - 1.04\%\,Si - 0.22\%\,Ni - 2.89\%\,C}{3.7\%\,N} > 18.9 \quad (3)$$

Nitrogen has also a limited solubility in solid phase. Precipitation of nitrides does not take place in practice if the following condition is valid:

$$[\%\ \text{austenite}] \cdot \left[\frac{\%\,Cr + 0.3\%\,Mn - 2\%\,Si - 0.2\%\,Ni}{4.31\%\,N}\right] > 1000 \quad (4)$$

The condition (4) is related to the solubility of nitrogen in the solid phase in a state of equilibrium. For that reason the nitrogen content shall be lower than 0.40% and preferably below 0.36%.

Carbon is like nitrogen a strong austenite former but has a smaller solubility than nitrogen. The carbon content is therefore limited to 0.05%, preferably less than 0.03%.

Silicon increases the fluidity in the steel manufacturing and welding and contributes also to the formation of ductile slags. But silicon also increases the tendency for precipitation of intermetallic phases and decreases the solubility of nitrogen. The silicon content is therefore limited to 0.8%, preferably less than 0.5%.

Figure 3:
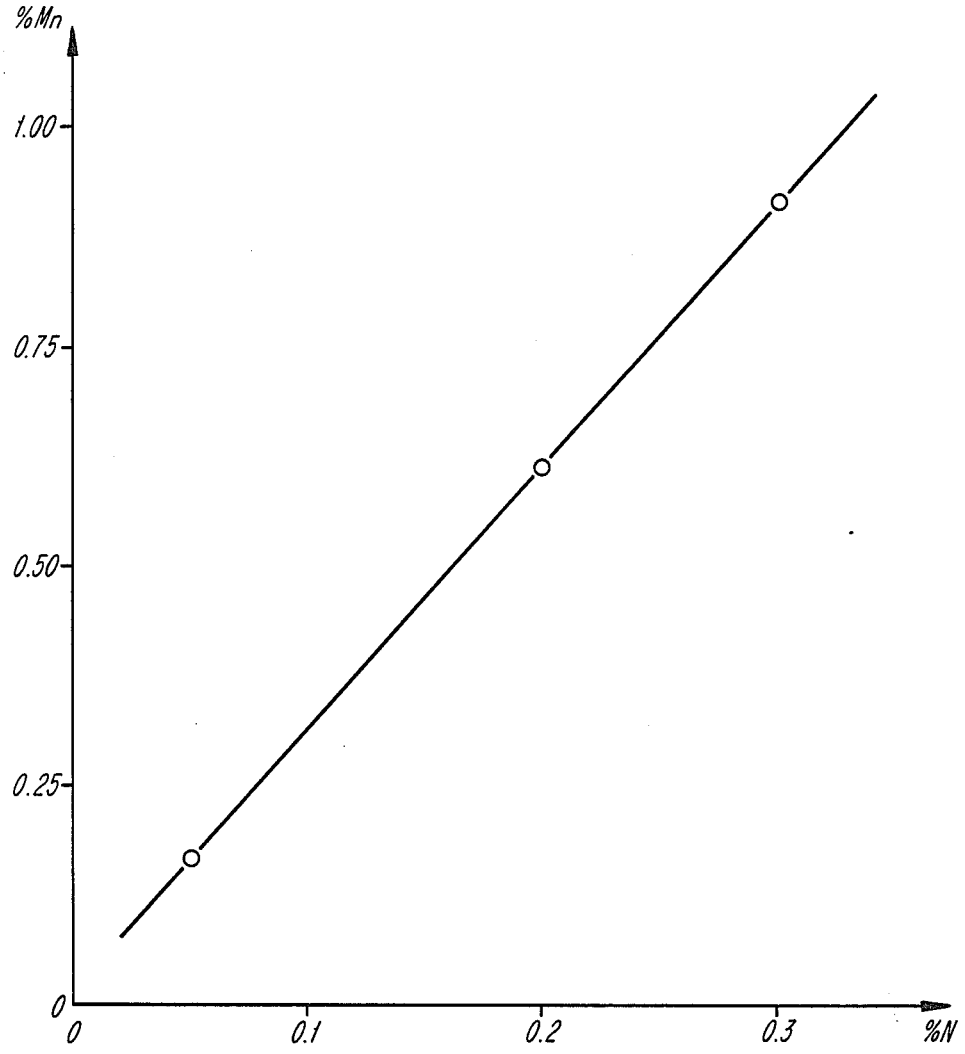
FIG. 3 is a graph of the sensitivity to corrosion for alloys containing nitrogen and manganese.

Manganese increases the solubility of nitrogen in the melt and the solid phase but increases the tendency for precipitation of intermetallic phases and deteriorates the corrosion characteristics. The content of manganese should therefore be limited to max 1.2%. Our investigations showed that there is a synergistic effect between nitrogen and manganese so that the critical manganese content, at which the corrosion resistance decreases, increases at an increasing content of nitrogen, see FIG. 3, at which the area above the line means sensitive to corrosion and the area below the line non-sensitive. A nitrogen content of more than 0.25% means therefore that about 0.8% Mn can be allowed without influencing the corrosion resistance negatively to any great extent. This reduces the cost of the alloy. The manganese content should therefore fulfill the condition $$\frac{\%\,Mn}{\%\,N} < 3.$$

Cerium gives an increased resistance to pitting and crevice corrosion by formation of cerium oxysulfides. Also the hot workability is improved. Up to 0.18% cerium is therefore desirable.

Nickel is an austenite former and it is needed to give the right microstructure. At least 5.5% is therefore required. But nickel is an expensive alloying element and it gives no positive effects in other respects. The nickel content is therefore limited to 9.0%. The content of nickel should preferably be in the interval of 6.5 to 8.5%.

Sulphur influences the corrosion resistance in a negative way by formation of easily soluble sulfides. The content of sulphur should therefore be limited to less than 0.010%, preferably less than 0.005%.

Copper influences the corrosion characteristics in a chloride-containing environment, as well as the microstructure in a marginal way. On the other hand, the corrosion resistance in acids such as sulfuric acid increases. Alloying with copper increases the manufacturing costs, however, because the return steel does not get the same usability. The copper content is therefore limited to 0.5%.

Vanadium increases the solubility of nitrogen in the melt. An addition of up to 0.5% gives an increased solubility of nitrogen with about 0.05% above what is obtained according to the condition or equation (3).

The ferrite content influences the phase composition, structure stability, hot workability and corrosion resistance. A ferrite content above 55%, after heat treatment around 1075° C., is not desirable because the nitrogen solubility in solid phase will then be limiting. Nor is a smaller ferrite content than about 30% desirable, because structure stability, corrosion resistance and hot workability will then decrease. The ferrite content also has to fulfill the conditions of corrosion resistance, structure stability and nitrogen solubility, see above.

As pointed out above, the structure stability was influenced by various alloying elements and the amount of ferrite. Our investigations have shown that the alloy according to the invention shall fulfill the following condition with respect to these two factors:

$$\frac{\%\ Cr + (\%\ Mo)^{1.8} + 5\%\ Si + \%\ W + 0.2\%\ Mn}{50\%\ N + \%\ ferrite} < 0.75$$

The alloy can then be manufactured clear of problems and welded also in heavy dimensions.

By optimizing the analysis of the alloy according to the conditions given in the preceding text it has been found possible to produce a steel alloy which in solution heat-treated, cold-worked and welded state is usable in applications where presence of chloride ions gives rise to a high corrosivity.

Samples according to the invention provided with crevices, with and without welds, have been tested in filtered sea water at 30° C. for 60 days with the following results:

| Alloy | Number of crevice attacks (24 crevices) | Maximum attacking depth, mm |
|---|---|---|
| 1. 25.3 Cr, 7.20 Ni, 4.1 Mo, 0.3 N | 0 | 0 |
| 2. Do. welded with matching filler material | 0 | 0 |
| 3. 22 Cr, 5.5 Ni, 3 Mo, 0.14 N | 16 | 0.6 |
| 4. 26 Cr, 5.8 Ni, 3.2 Mo, 0.16 N, 1.4 Cu | 8 | 0.4 |
| 5. 25 Cr, 6.2 Ni, 3.1 Mo, 0.3 W, 0.6 Cu, 0.16 N | 6 | 0.3 |
| 6. 25 Cr, 6.7 Ni, 3.0 Mo, 0.16 N | 6 | 0.3 |

The results show that the alloy according to the invention has an essentially better corrosion resistance than other ferrite-austenitic alloys which do not fulfill the conditions above.

As earlier mentioned, the claimed alloy is particularly suitable for the manufacturing of products demanding a good workability and weldability. Said properties are drastically impaired, however, if the contents of Cr and/or particularly of Mo are above those of the claimed range. An alloy containing the claimed content of Cr, but a Mo-content of 5–7% gives thus a combination which cannot be manufactured by conventional methods (such as forging, hot-rolling, extrusion, etc.). Furthermore, the mentioned alloy cannot be welded without precipitation of intermetallic phases, which leads to lowered impact strength.

From the earlier mentioned condition with respect to structure stability:

$$\frac{\%\ Cr + (\%\ Mo)^{1.8} + 5\%\ Si + \%\ W + 0.2\%\ Mn}{50\%\ N + \%\ ferrite} < 0.75$$

it is evident that Mo strongly decreases the tendency for precipitation of intermetallic phases.

The validity of said condition or equation has been verified by the following results. The structure stability of three alloy compositions (see below) has been examined by heat treating in 1, 3 and 10 min. at 700°, 800°, 900° and 1000° C. with subsequent quenching in water.

| | C | Si | Mn | P | S | Cr | Ni | Mo | V | W | N | % ferrite |
|---|---|---|---|---|---|---|---|---|---|---|---|---|
| Alloy 1 | .015 | .29 | .44 | .008 | .003 | 24.2 | 7.38 | 4.11 | .20 | .01 | .26 | 42 |
| Alloy 2 | .020 | .33 | .47 | .012 | .003 | 24.99 | 7.5 | 4.02 | .18 | .01 | .32 | 40 |
| Alloy 3 | .021 | .31 | .40 | .007 | .003 | 26.1 | 8.64 | 5.87 | .20 | .01 | .29 | 50 |

The impact strength after respective heat treatment is shown below:

| Temp (°) | Time (min) | Impact strength (J)* Alloy 1 | Alloy 2 | Alloy 3 |
|---|---|---|---|---|
| 1000 | 1 | 106 | 110 | 11 |
| | 3 | 64 | 60 | 9 |
| | 10 | 69 | 57 | 12 |
| 900 | 1 | 42 | 47 | 4 |
| | 3 | 25 | 26 | 4 |
| | 10 | 6 | 6 | 3 |
| 800 | 1 | 286 | >300 | 271 |
| | 3 | 285 | 290 | 101 |
| | 10 | 46 | 51 | 3 |
| 700 | 3 | >300 | >300 | 285 |
| | 10 | >300 | >300 | 261 |

*Charpy-V-test (10 × 10 mm)

It is evident that the alloy 3 is very unstable at 900°–1000° C. In normal production (such as forging, hot-rolling, extrusion etc) and in welding, the rapid precipitation of intermetallic phases causes a destructive embrittlement which makes a conventional use of the alloy impossible. Alloy 3, which is outside the claimed invention, does not fulfill the above-mentioned equation, which the alloys 1 and 2 do.

It has also been verified that the cast ingots have a great number of nitrogen blisters in those alloys which do not fulfill the equation (3) in the specification.

In an investigation, the following alloy compositions (see below) were examined after casting:

| | C | Si | Mn | Cr | Ni | Mo | N |
|---|---|---|---|---|---|---|---|
| Alloy 3 | .009 | .32 | .47 | 24.81 | 6.87 | 3.96 | .28 |
| Alloy 4 | .009 | .29 | .43 | 25.19 | 6.29 | 4.02 | .37 |

-continued

| | C | Si | Mn | Cr | Ni | Mo | N |
|---|---|---|---|---|---|---|---|
| Alloy 5 | .010 | .29 | .42 | 25.16 | 5.68 | 4.03 | .37 |
| Alloy 6 | .010 | .27 | .37 | 25.03 | 6.85 | 4.03 | .29 |
| Alloy 7 | .014 | .27 | .46 | 24.98 | 6.78 | 3.98 | .32 |
| Alloy 8 | .015 | .29 | .41 | 24.97 | 6.21 | 4.01 | .36 |
| Alloy 9 | .010 | .23 | .38 | 24.97 | 7.03 | 4.00 | .29 |
| Alloy 10 | .011 | .24 | .39 | 25.10 | 7.26 | 4.03 | .29 |

The results are shown below:

| | Remarks | Equation (3) |
|---|---|---|
| Alloy 3 | OK | 23.21 |
| Alloy 4 | Many nitrogen blisters | 17.96 (<18.9) |
| Alloy 5 | Many nitrogen blisters | 15.48 (<18.9) |
| Alloy 6 | OK | 22.64 |
| Alloy 7 | OK | 20.50 |
| Alloy 8 | Nitrogen blisters | 18.28 (<18.9) |
| Alloy 9 | OK | 22.58 |
| Alloy 10 | OK | 22.65 |

It is evident that those alloys in which the value of equation (3) is <18.9 show the presence of nitrogen blisters and are outside the scope of the invention even though the composition fulfills the claimed range.

We claim:

1. A high nitrogen-containing duplex stainless steel with high corrosion resistance, good structure stability, and good workability and weldability, characterized in that the alloy contains, in % by weight, max 0.05% C, 23–27% Cr, 5.5–9% Ni, 0.25–0.40% N, max 0.8% Si, max 1.2% Mn, 3.5–4.9% Mo, max 0.5% Cu, max 0.5% W, max 0.010% S, up to 0.5% V, up to 0.18% Ce, balance Fe with incidental impurities and in which the contents of the alloying elements are adjusted that the following conditions are fulfilled:

(a) $\% Cr + 3.3 (\% Mo) + 16 (\% N) - 1.6 (\% Mn) - 122 (\% S) > 39.1$;

$$\frac{\% M}{\% N} < 3; \quad \text{(b)}$$

(c) $65 < 71.1 + 9 (7.5 - \% Ni) + 190 (0.03 - \% C) + 160 (0.25 - \% N) + 5.3 (\% Cr - 25) + 8 (\% Mo - 4) < 75$;

$$\% N \geqq \frac{1075 - 16(\% Cr - 25) + 52(\% Mo - 4)}{4064}; \quad \text{(d)}$$

(e) the ferrite content after solution heat treatment at about 1075° C. is between 30 and 55%; and $$\frac{\% Cr + (\% Mo)^{1.8} + 5\% Si + \% W + 0.2\% Mn}{50\% N + \% ferrite} < 0.75 \quad \text{(f)}$$

2. Alloy according to claim 1, characterized in that the content of C is max 0.03%.

3. Alloy according to claim 1, characterized in that the content of Si is max 0.5%.

4. Alloy according to claim 1, characterized in that the content of N is 0.28–0.36%.

5. Alloy according to claim 1, characterized in that the Cr content is 24.5–27% and the Ni content is 6.5–8.5%.

6. Alloy according to claim 1, characterized in that the content of Mo is 3.8–4.9%.

7. Alloy according to claim 6, characterized in that the content of Mo is 4.05–4.9%.

8. A high nitrogen containing duplex stainless steel alloy according to claim 1 in a solution heated, cold worked and welded state used in applications where the presence of chloride ions gives rise to a high corrosivity.

* * * * *